US007845665B2

(12) United States Patent
Borisoff

(10) Patent No.: US 7,845,665 B2
(45) Date of Patent: Dec. 7, 2010

(54) WHEELCHAIR

(76) Inventor: Jaimie Borisoff, 2424 Maple Street, Apt. 109, Vancouver, British Columbia (CA) V6J 4Y1

( * ) Notice: Subject to any disclaimer, the term of this patent is extended or adjusted under 35 U.S.C. 154(b) by 325 days.

(21) Appl. No.: 11/887,661

(22) PCT Filed: Mar. 29, 2006

(86) PCT No.: PCT/CA2006/000475

§ 371 (c)(1),
(2), (4) Date: Sep. 27, 2007

(87) PCT Pub. No.: WO2006/102754

PCT Pub. Date: Oct. 5, 2006

(65) Prior Publication Data

US 2009/0146389 A1 Jun. 11, 2009

Related U.S. Application Data

(60) Provisional application No. 60/666,194, filed on Mar. 30, 2005.

(51) Int. Cl.
*A61G 5/14* (2006.01)

(52) U.S. Cl. ..... 280/250.1; 280/304.1

(58) Field of Classification Search ..... 280/250.1, 280/304.1

See application file for complete search history.

(56) References Cited

U.S. PATENT DOCUMENTS 3,343,871 A 9/1967 Yates et al.

(Continued)

FOREIGN PATENT DOCUMENTS

GB 2154440 A 9/1985

(Continued)

OTHER PUBLICATIONS

Cooper et al., "Trends and Issues in Wheeled Mobility Technologies," Space Requirements for Wheeled Mobility Workshop: An International Workshop, at Center for Inclusive Design and Environmental Access, University of Buffalo, http://www.ap.buffalo.edu/idea/space%20workshop/papers.htm. pp. 1-26 (Oct. 9-11, 2003).

(Continued)

*Primary Examiner*—Lesley Morris
*Assistant Examiner*—Michael R Stabley
(74) *Attorney, Agent, or Firm*—Ryan W. Dupuis; Kyle R. Satterthwaite; Ade & Company Inc.

(57) ABSTRACT

A wheelchair according to one embodiment is provided with a frame and a seat assembly that is movable in elevation relative to the frame. The frame has a seat hinge mounted thereto, and is rotatably coupled to left and right wheels. The seat assembly has a side member hingedly coupled to the seat hinge and a seat back hingedly coupled to the side member such that the seat back can be maintained at a constant angle relative to the frame when the side member pivots about the seat hinge and moves the seat assembly between multiple elevations. The wheelchair also comprises a lockable spring hingedly mounted to the frame and to the seat assembly; the spring is lockable at multiple positions thereby locking the seat assembly at the multiple elevations. This spring can be sufficiently elastic to suspend the seat assembly and absorb shock at each of the locked multiple elevations.

25 Claims, 11 Drawing Sheets

U.S. PATENT DOCUMENTS

| | | | | | |
|---|---|---|---|---|---|
| 3,851,917 | A | | 12/1974 | Horstmann et al. | |
| 3,907,051 | A | | 9/1975 | Weant et al. | |
| 3,937,490 | A | | 2/1976 | Nasr | |
| 3,937,519 | A | | 2/1976 | Schoolden | |
| 3,953,054 | A | | 4/1976 | Udden et al. | |
| 3,964,786 | A | * | 6/1976 | Mashuda | 297/330 |
| 4,044,850 | A | | 8/1977 | Winsor | |
| 4,076,304 | A | * | 2/1978 | Deucher | 297/45 |
| 4,098,521 | A | | 7/1978 | Ferguson et al. | |
| 4,127,200 | A | | 11/1978 | Mann | |
| 4,141,094 | A | | 2/1979 | Ferguson et al. | |
| 4,273,350 | A | | 6/1981 | Williams | |
| 4,324,414 | A | | 4/1982 | Wilkes | |
| 4,326,732 | A | | 4/1982 | Gall et al. | |
| 4,390,076 | A | | 6/1983 | Wier et al. | |
| 4,415,202 | A | | 11/1983 | Pew | |
| 4,431,076 | A | | 2/1984 | Simpson | |
| 4,432,425 | A | | 2/1984 | Nitzberg | |
| 4,455,029 | A | | 6/1984 | Taylor | |
| 4,462,604 | A | | 7/1984 | Meyer | |
| 4,477,098 | A | | 10/1984 | Minnebraker | |
| 4,477,117 | A | | 10/1984 | Higgs | |
| 4,483,653 | A | | 11/1984 | Waite | |
| 4,489,955 | A | | 12/1984 | Hamilton | |
| 4,500,102 | A | | 2/1985 | Haurey et al. | |
| 4,515,383 | A | | 5/1985 | Minnebraker | |
| 4,519,649 | A | * | 5/1985 | Tanaka et al. | 297/316 |
| 4,545,593 | A | | 10/1985 | Farnam | |
| 4,565,385 | A | | 1/1986 | Morford | |
| 4,566,707 | A | | 1/1986 | Nitzberg | |
| 4,569,094 | A | | 2/1986 | Hart et al. | |
| 4,574,901 | A | | 3/1986 | Joyner | |
| 4,577,878 | A | | 3/1986 | Roy et al. | |
| 4,592,570 | A | | 6/1986 | Nassiri | |
| 4,593,929 | A | | 6/1986 | Williams | |
| 4,598,944 | A | | 7/1986 | Meyer et al. | |
| 4,606,082 | A | | 8/1986 | Kuhlman | |
| 4,607,860 | A | | 8/1986 | Vogel | |
| RE32,242 | E | | 9/1986 | Minnebraker | |
| 4,613,151 | A | | 9/1986 | Kielczewski | |
| 4,614,246 | A | * | 9/1986 | Masse et al. | 180/6.5 |
| 4,617,919 | A | | 10/1986 | Suhre | |
| 4,623,194 | A | * | 11/1986 | Pillot | 297/316 |
| 4,648,619 | A | | 3/1987 | Jungnell et al. | |
| 4,650,201 | A | | 3/1987 | Hartwell | |
| 4,652,005 | A | | 3/1987 | Hartwell | |
| 4,676,519 | A | | 6/1987 | Meier | |
| 4,679,816 | A | | 7/1987 | Riikonen | |
| 4,684,149 | A | | 8/1987 | Meyer | |
| 4,684,171 | A | | 8/1987 | Roy et al. | |
| 4,685,693 | A | | 8/1987 | Vadjunec | |
| 4,732,402 | A | | 3/1988 | Lambert | |
| 4,744,578 | A | | 5/1988 | Stearns | |
| 4,754,987 | A | | 7/1988 | Williams | |
| 4,805,712 | A | | 2/1989 | Singleton | |
| 4,805,931 | A | | 2/1989 | Slasor | |
| 4,825,971 | A | | 5/1989 | Bernstein | |
| 4,852,899 | A | | 8/1989 | Kueshall | |
| 4,863,181 | A | | 9/1989 | Howle | |
| 4,886,288 | A | | 12/1989 | Dysarz | |
| 4,917,395 | A | | 4/1990 | Gabriele | |
| 4,934,722 | A | | 6/1990 | Goetzelma | |
| 4,934,723 | A | | 6/1990 | Dysarz | |
| 4,934,725 | A | | 6/1990 | Owens | |
| 4,948,156 | A | | 8/1990 | Fortner | |
| 4,955,624 | A | | 9/1990 | Jeun-Long | |
| 4,960,180 | A | | 10/1990 | Livingston | |
| 4,968,050 | A | | 11/1990 | Kendrick et al. | |
| 4,989,890 | A | | 2/1991 | Lockard et al. | |
| 4,995,628 | A | | 2/1991 | Orpwood et al. | |
| 5,011,175 | A | | 4/1991 | Nicholson et al. | |
| 5,020,816 | A | | 6/1991 | Mulholland | |
| 5,028,065 | A | | 7/1991 | Danecker | |
| 5,064,211 | A | | 11/1991 | Huttenhuis et al. | |
| 5,076,390 | A | | 12/1991 | Haskins | |
| 5,076,602 | A | | 12/1991 | Robertson et al. | |
| 5,108,202 | A | * | 4/1992 | Smith | 297/330 |
| 5,112,076 | A | | 5/1992 | Wilson | |
| 5,116,067 | A | | 5/1992 | Johnson | |
| 5,141,250 | A | | 8/1992 | Morgan et al. | |
| 5,143,391 | A | | 9/1992 | Robertson et al. | |
| 5,145,197 | A | | 9/1992 | Gatti | |
| 5,176,393 | A | | 1/1993 | Robertson et al. | |
| 5,186,480 | A | | 2/1993 | Morgan et al. | |
| 5,209,322 | A | | 5/1993 | McMahon | |
| 5,211,414 | A | | 5/1993 | Galumbeck | |
| 5,217,239 | A | | 6/1993 | Koet | |
| 5,240,277 | A | * | 8/1993 | Scheulderman | 280/650 |
| 5,259,635 | A | | 11/1993 | Picker | |
| 5,263,728 | A | | 11/1993 | Patel et al. | |
| 5,267,745 | A | | 12/1993 | Robertson et al. | |
| 5,294,142 | A | | 3/1994 | Weege | |
| 5,301,964 | A | | 4/1994 | Papac | |
| 5,326,120 | A | | 7/1994 | Weege | |
| 5,346,280 | A | | 9/1994 | Deumite | |
| 5,360,224 | A | | 11/1994 | Geiger et al. | |
| 5,363,934 | A | | 11/1994 | Edmund et al. | |
| 5,401,044 | A | | 3/1995 | Galumbeck | |
| 5,409,247 | A | | 4/1995 | Robertson et al. | |
| 5,421,598 | A | | 6/1995 | Robertson et al. | |
| 5,437,497 | A | | 8/1995 | Hutson | |
| 5,480,179 | A | | 1/1996 | Peacock | |
| 5,484,151 | A | | 1/1996 | Tholkes | |
| 5,489,258 | A | | 2/1996 | Wohnsen et al. | |
| 5,490,687 | A | | 2/1996 | Scholl | |
| 5,513,867 | A | * | 5/1996 | Bloswick et al. | 280/250.1 |
| 5,520,403 | A | | 5/1996 | Bergstrom et al. | |
| 5,556,121 | A | | 9/1996 | Pillot | |
| 5,590,893 | A | | 1/1997 | Robinson et al. | |
| 5,593,173 | A | | 1/1997 | Williamson | |
| 5,601,302 | A | | 2/1997 | Beard et al. | |
| 5,609,348 | A | | 3/1997 | Galumbeck | |
| 5,613,697 | A | | 3/1997 | Johnson | |
| 5,619,762 | A | | 4/1997 | Mein | |
| 5,667,235 | A | | 9/1997 | Pearce et al. | |
| 5,727,802 | A | | 3/1998 | Garven et al. | |
| 5,727,809 | A | | 3/1998 | Ordelman et al. | |
| 5,743,545 | A | | 4/1998 | Kunze et al. | |
| 5,758,897 | A | | 6/1998 | Kueschall | |
| 5,772,226 | A | * | 6/1998 | Bobichon | 280/250.1 |
| 5,782,483 | A | | 7/1998 | Rogers et al. | |
| 5,855,387 | A | | 1/1999 | Gill et al. | |
| 5,865,457 | A | | 2/1999 | Knabusch et al. | |
| 5,884,928 | A | | 3/1999 | Papac | |
| 5,984,338 | A | * | 11/1999 | Meyer | 280/304.1 |
| 5,996,716 | A | | 12/1999 | Montiglio et al. | |
| 6,003,891 | A | | 12/1999 | Broadhead | |
| 6,027,132 | A | | 2/2000 | Robinson et al. | |
| 6,032,976 | A | | 3/2000 | Dickie et al. | |
| 6,053,519 | A | | 4/2000 | Poindexter et al. | |
| 6,068,280 | A | | 5/2000 | Torres | |
| 6,089,593 | A | | 7/2000 | Hanson et al. | |
| 6,092,822 | A | | 7/2000 | Salmon | |
| 6,135,476 | A | | 10/2000 | Dickie et al. | |
| 6,135,480 | A | | 10/2000 | James | |
| 6,139,037 | A | | 10/2000 | Papac | |
| 6,154,690 | A | | 11/2000 | Coleman | |
| 6,161,856 | A | | 12/2000 | Peterson | |
| 6,168,178 | B1 | | 1/2001 | Garven et al. | |
| 6,192,533 | B1 | | 2/2001 | Porcheron | |
| 6,206,393 | B1 | | 3/2001 | Mascari et al. | |
| 6,217,114 | B1 | | 4/2001 | Degonda | |
| 6,247,718 | B1 | | 6/2001 | Gobbers et al. | |
| 6,250,717 | B1 | * | 6/2001 | Porcheron | 297/411.3 |

6,264,225 B1 7/2001 Kunishige et al.
6,276,704 B1 8/2001 Suiter
6,296,265 B1 10/2001 Lovins
6,302,429 B1 10/2001 Friedrich
6,315,319 B1 11/2001 Hanson et al.
6,325,399 B1 12/2001 DeMoss
6,352,275 B1 3/2002 Lindenkamp
6,394,476 B1 5/2002 Molnar
6,412,804 B1 7/2002 Dignat
6,419,253 B1 7/2002 Mascari
6,419,260 B1 7/2002 Kuroda
6,428,029 B1 8/2002 Barclay
6,431,650 B1 * 8/2002 Visone ..... 297/339
6,447,064 B1 9/2002 Mundy et al.
6,454,285 B1 9/2002 Koenig
6,464,243 B2 10/2002 Roche
6,467,785 B2 10/2002 Toppses
6,513,824 B2 2/2003 DuBose
6,533,304 B2 3/2003 Lizama-Troncoso et al.
6,540,250 B1 4/2003 Peterson
6,619,681 B2 9/2003 Gutierrez
6,648,359 B2 11/2003 Chen et al.
6,705,629 B2 * 3/2004 Post et al. ..... 280/250.1
6,769,705 B1 8/2004 Schlangen
6,773,032 B2 8/2004 Redman et al.
6,799,770 B2 10/2004 Patrick et al.
6,846,042 B2 * 1/2005 Hanson et al. ..... 297/411.36
6,866,288 B2 3/2005 Martin
6,889,993 B2 5/2005 Chen et al.
6,935,648 B2 8/2005 Beck
6,994,364 B2 2/2006 Nelson et al.
7,007,963 B2 3/2006 Meyer
7,007,965 B2 3/2006 Bernatsky et al.
7,100,716 B2 9/2006 Engels et al.
7,243,935 B2 7/2007 Beumer
2001/0011805 A1 * 8/2001 Kueschall ..... 280/250.1
2002/0056970 A1 5/2002 Groth
2002/0149168 A1 10/2002 Brown
2003/0006578 A1 1/2003 Melgarejo et al.
2003/0011229 A1 1/2003 Bell
2003/0205883 A1 11/2003 Bergstrom et al.
2004/0183276 A1 9/2004 Silva
2007/0296177 A1 * 12/2007 Porcheron ..... 280/250.1

FOREIGN PATENT DOCUMENTS

GB 2388574 11/2003
NL 9400853 1/1996
NL 1017127 C 1/2001
WO WO03/061543 A1 7/2003

OTHER PUBLICATIONS

Internet website, "The CAT Manual Wheelchair," www.Movingpeople.net, (2 pages), 2006.
Internet website, LEVO AG, "LEVO active-easy LAE," www.levousa.com, (1 page), 2006.
Internet website, LEVO AG, "The new LEVO," www.levo.ch, (3 pages), 2006.
Internet website, LifeStand, "Vivre-Debout", "LS": The Manual Stand-up Wheelchair, www.lifestandusa.com, (7 pages), 2006.
Internet website, Product Design Group (PDG), "Stellar Manual Tilt Wheelchair," www.pdgmobility.com, (2 pages), 2006.

* cited by examiner

WHEELCHAIR

CROSS REFERENCE TO RELATED APPLICATIONS

This is the U.S. National Stage of International Application No. PCT/CA2006/000475, filed Mar. 29, 2006, which in turn claims the benefit of U.S. Provisional Application No. 60/666,194, filed Mar. 30, 2005.

FIELD OF THE INVENTION

This invention relates generally to wheelchairs, and in particular to a wheelchair with a height adjustable seat.

BACKGROUND OF THE INVENTION

Manual wheelchair technology has greatly improved over the last 100 plus years such that many existing wheelchairs on the market today provide a very functional mobility device for active independent individuals with disability. One class of wheelchair, known as "ultra-lightweight" wheelchairs, are very light and enable a user to efficiently self-propel as well as to easily manipulate the wheelchair, e.g. to lift the wheelchair into a car. Many of these types of wheelchairs are engineered with a minimal number of components to keep weight down; such a design also has the added benefit of minimizing the visual impact of the wheelchair, thus focussing the attention of others to the user instead of the wheelchair.

The technology improvements that have led to ultra-lightweight and other types of wheelchairs have incremented over the years in the form of improved adjustability, stability, suspension, and weight. However, current state of the art chairs still suffer from the problem that once they are set up with a certain configuration, the user cannot easily alter the selected configuration. For example, ultra-lightweight chairs in particular do not let the user dynamically (in real-time) change their seating position without getting out of the chair to reconfigure the chair's configuration.

Users may prefer different seating positions for different tasks, and thus it is desirable to be able to easily reconfigure the seating position of the chair. For instance, it is desirable to sit much lower in an increased "dump" position (i.e. at a negative seat angle below the horizontal) in a chair when wheeling, much like tennis chairs or track chairs. When in this type of position, a user is more stable and is able to wheel more efficiently. The drawback to this position is that it can become uncomfortable over a long period of time and the user is at an even lower position, which entails all the negative issues associated with being 'short'. On other occasions, it is desirable to be able to elevate the wheelchair seat above the normal sitting position. For example, an elevated position is useful for accessing countertops and higher shelves, sitting at similar heights to others (e.g. on bar stools), participating in certain activities like playing pool, and to more closely approximate the height of other people.

There is a class of wheelchairs known as "standing chairs" which offer a certain degree of dynamic seat height adjustment. Such chairs enable the user to adjust his or her height between a sitting position to a full standing position without getting out of the chair. However, these chairs suffer a major drawback in that they tend to be heavier than ultralight chairs as a result of incorporating the numerous mechanisms required to lift the user to a standing height. Furthermore, the complex mechanisms interfere with the seat's ability to lower to a sufficient low position that enables comfortable and efficient self propulsion.

There is another class of wheelchairs known as "tilt chairs" which offer individuals who are typically very disabled the ability to be put into a tilted position whereby their weight is shifted from primarily the buttocks to a larger area including the user's back, in order to redistributed the pressure on the skin. Typically the tilting operation is operated by an attendant due to the high level of disability of the user. Such chairs seek a very large degree of rearward tilt (approximately 45 degrees) that necessitate specific linkages and pivot positions. In one prior art approach, the seat pivot is placed several inches rearward of the seat front, and several inches below the seat. This pivot position, along with appropriate biasing mechanisms to tune the force of the lifting mechanism to individual user weights, enables very weak individuals to independently position themselves throughout the seat range. A disadvantage of this approach is that a user's knees move upwards as the seat is tilted which may prevent a user from fitting their legs under a table when tilted. Due to their specific design criteria, these chairs also may not provide positive tilt above the horizontal. As well the backrest assembly tilts with the seat which may inhibit the user from achieving efficient wheeling power when the seat is tilted below the horizontal.

SUMMARY OF THE INVENTION

It is therefore an object of the invention to provide a manual wheelchair that enables a user to easily and efficiently self-propel, as well as to dynamically adjust the seat height of the wheelchair to accommodate various situations. It is also desirable that the mechanism that lowers the wheelchair seat results in a relatively constant knee height position, for instance to facilitate access under table tops or sinks. Furthermore, it is desirable to provide a wheelchair that can keep its backrest at a relatively constant angle to the wheelchair frame at all angles of the seat bottom, and to provide a wheelchair that can absorb the shocks encountered during wheelchair travel, as well as allow the user to easily change the seat height without having to leave the chair.

It is also an object of the invention to provide a wheelchair of which a user can independently and in real-time change the seat height above and below the horizontal without the need for added components that impact the complexity and more significantly the weight of the wheelchair. (Ultra-light wheelchairs for independent individuals must be kept at a low weight so that the user can fulfil the various tasks of the everyday lives, such as transferring to a car and lifting the chair into the car.)

According to one aspect of the invention there is provided a wheelchair comprising: a frame having a front portion with a seat hinge mounted thereto at a first elevation, and a rear portion rotatably coupled to left and right wheels; and a seat assembly comprising at least one side member hingedly coupled to the seat hinge, and a seat back hingedly coupled to the side member such that the seat back can be maintained at a constant angle relative to the frame when the side member pivots about the seat hinge and moves the seat assembly between multiple elevations. The wheelchair also comprises a lockable spring hingedly mounted to the frame and to the seat assembly; the spring is lockable at multiple positions thereby locking the seat assembly at the multiple elevations. This spring can be sufficiently elastic to suspend the seat assembly and absorb shock at each of the locked multiple elevations.

The wheelchair can also comprise a hand-operated actuator coupled to the spring and operable to lock the spring in each of the multiple positions. The actuator is located on the wheelchair in a position that allows a user sitting in the wheelchair to use the same hand to actuate the actuator and at least partially lift the user off the seat assembly. The actuator can be positioned on the frame, and can, for example, be located sufficiently close to a rim of the wheel that the user can grasp the rim and actuator at the same time, and be located sufficiently close to a vertical centreline of an axle of the wheel that the user can at least partially lift the user off the seat assembly without causing the wheel to rotate. Alternatively, the actuator can be positioned on the seat assembly, and can, for example, can be located on the side member sufficiently close to the frame that the user can at least partially lift the user off the seat assembly or pull the seat assembly downwards.

The seat assembly can also comprise a seat bottom and at least one side guard connecting the seat back to the seat bottom. This side guard is operable to maintain the seat bottom at substantially the same angle to the seat back at each of the multiple elevations. The side guard can be adjustable in length, whereupon adjustment of the side guard length adjusts the seat bottom angle relative to the seat back at each of the multiple elevations. Alternatively, the side guard can comprise a flexible material such that the seat bottom angle can be adjusted relative to the seat back by flexing the flexible material.

DETAILED DESCRIPTION OF EMBODIMENTS OF THE INVENTION

Directional terms such as "left", "right", "horizontal", "vertical", "transverse" and "longitudinal" are used in this description merely to assist the reader to understand the described embodiments and are not to be construed to limit the orientation of any described method, product, apparatus or parts thereof, in operation or in connection to another object.

Referring to FIGS. 1 to 5 and according to one embodiment of the invention, a wheelchair 1 is provided having a seat assembly 12 having a front end that is pivotably coupled to a wheelchair frame 2 such that the seat assembly 12 height is adjustable relative to the frame 2. The seat assembly 12 is suspended by a pair of gas springs 25 which are adjustable to adjust the seat assembly 12 height relative to the frame 2 as well as to serve as shock absorbers to cushion a user during wheelchair travel.

Figure 2:
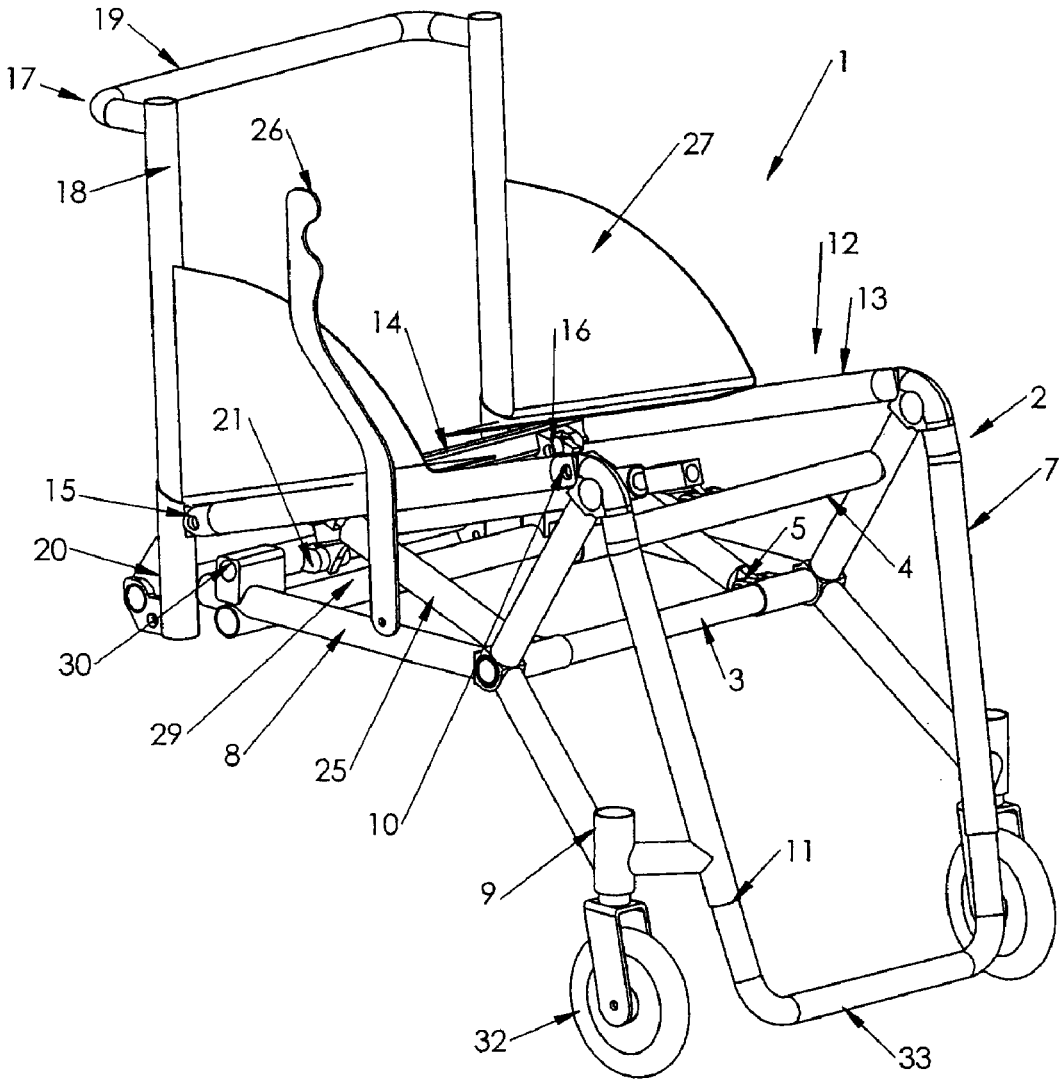
FIG. 2 is a perspective view of a frame assembly of the wheelchair in FIG. 1, with its seat at a lowered elevation.
Figure 3:
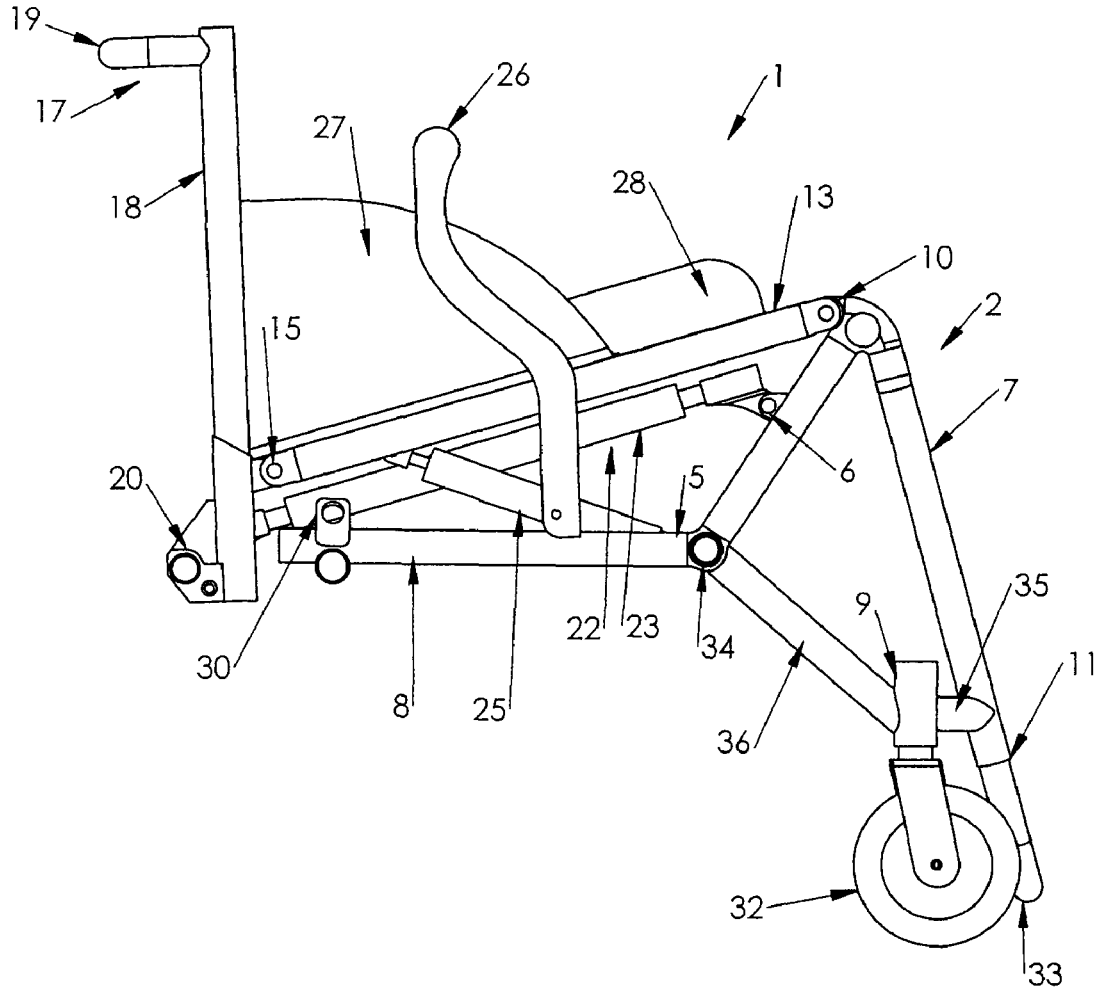
FIG. 3 is a side elevation view of the frame assembly with its seat at a lowered elevation.

Referring particularly to FIGS. 2 and 3, the frame 2 comprises a transversely-extending middle cross member 3 and a transversely-extending upper cross member 4 both connected to longitudinally-extending, transversely-spaced left and right side members 8. The side members 8 each have a rear tube and a front tube joined together at their respective front and rear ends by a joint 34; the rear tube extends generally horizontally (when the wheelchair 1 is on flat ground in its typical operational position) and the front tube extends forwardly at an upward angle from the joint 34. Alternatively, the side members 8 can be a single elongated tube bent into similar shape. The middle cross member 3 is connected to each joint 34, and the front cross member 4 is connected to the front end of each side member 8. Alternatively, the middle cross member 3 can be attached to a different location on the frame 2 depending on design considerations such as the type of gas spring used, length of desired stroke, etc.

Figure 1:
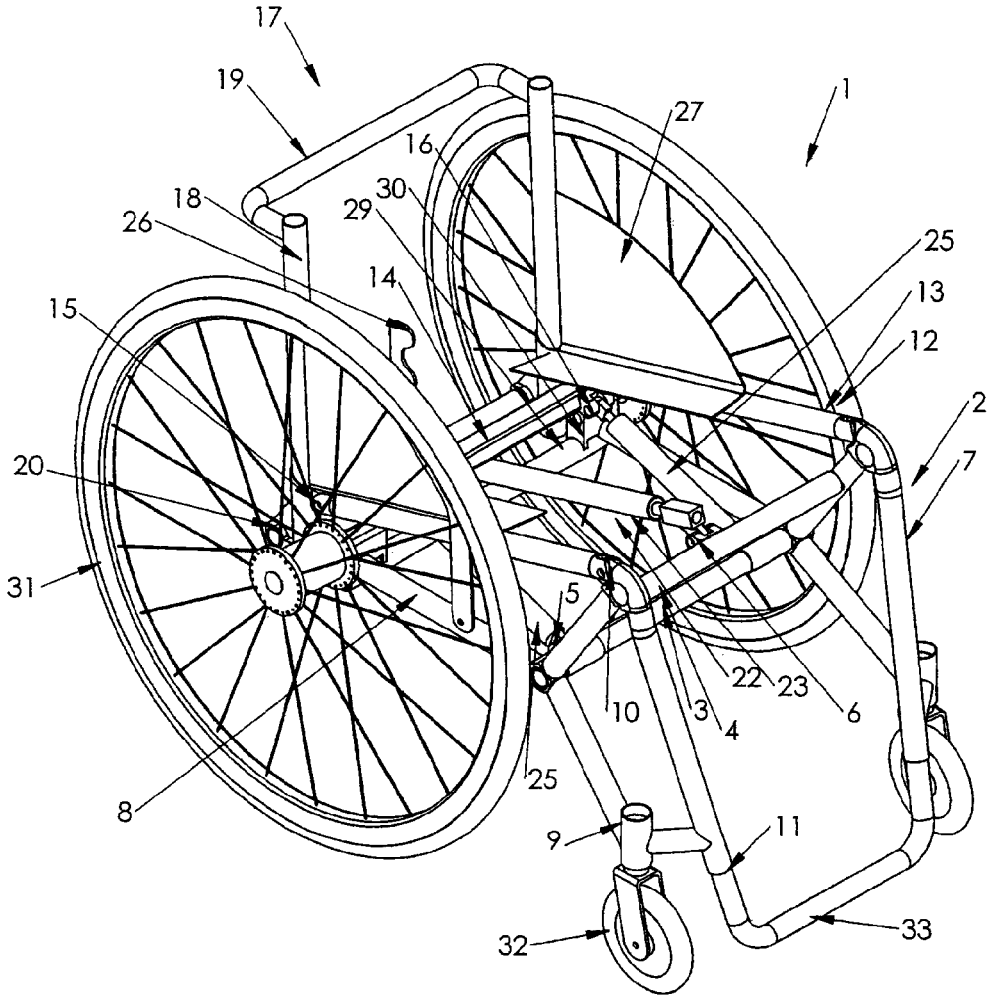
FIG. 1 is a perspective view of a wheelchair according to one embodiment of the invention, with portions of the wheelchair's seat removed for ease of viewing.
Figure 4:
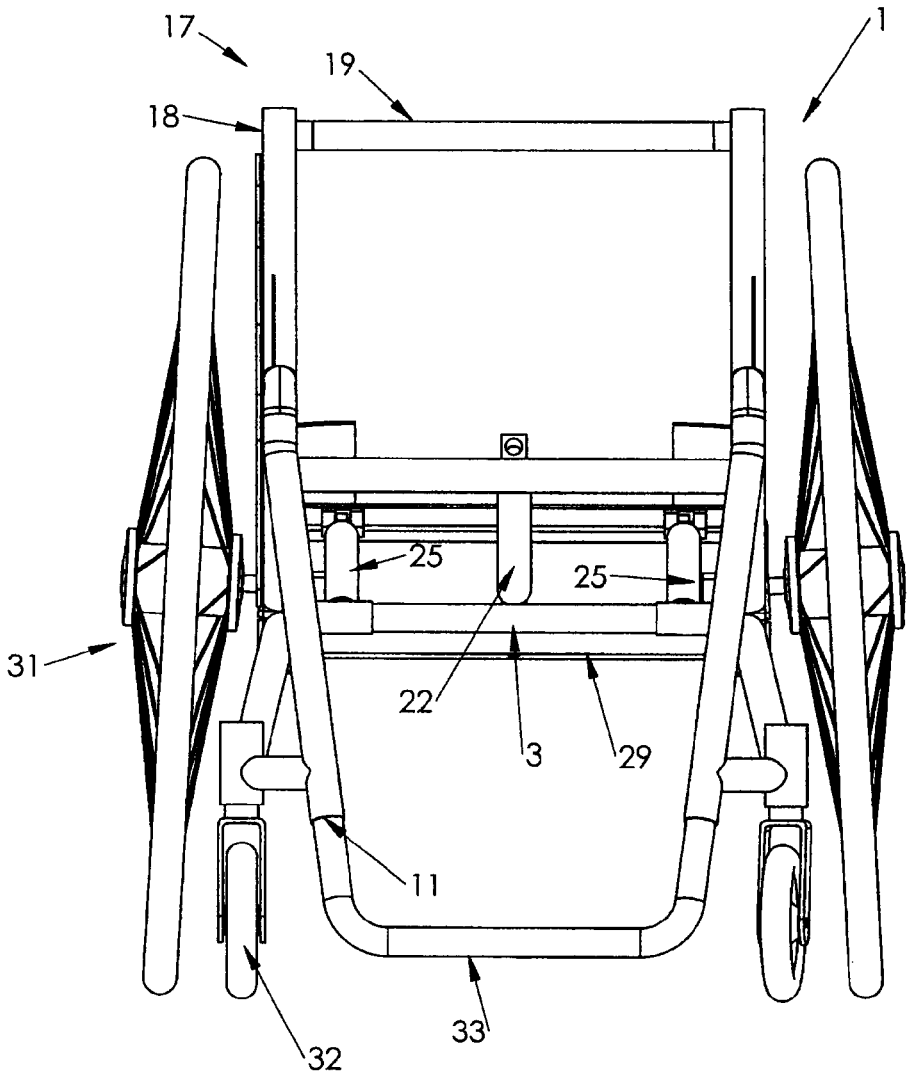
FIG. 4 is a front elevation view of the wheelchair.

The frame 2 also comprises a transversely-extending camber member 29 that is connected near the rear end of each side member 8. A camber block 30 is mounted to the frame 2 at each intersection of the camber member 29 and side member 8. The camber member 29 provides support for the camber blocks 30 and stiffens the frame 2, and is located below the camber block 30 in order to provide sufficient clearance for the seat, as will be described in further detail below. Referring particularly to FIGS. 1 and 4, a wheel 31 is rotatably mounted to each camber block 30. Construction of the wheels 31 and the manner of their attachment to the camber blocks 30 are well known in the art and thus not described here.

A footrest frame tube 7 extends forwardly and at a downward angle from the front end of each of the frame side members 8. A U-shaped tubular footrest 33 has a pair of arms that are slidable through openings 11 in the foot rest frame tubes 7 and enables the footrest 33 to be slid between an extended position and a retracted position relative to the footrest frame tubes 7; the footrest 33 can be fastened to the footrest frame tubes 7 by conventional means, e.g. a pin insertable through spaced holes in both the footrest 33 and footrest frame tubes 7 (not shown).

A castor housing 9 vertically pivotably housing a castor 32 is attached to each footrest frame tube 7 and each frame side member 8 by respective front and rear castor members 35, 36. In particular, the front castor member 35 attaches the castor housing 9 to the base of the footrest frame tube 7, and the rear castor member 36 attaches the castor to the longitudinal member joint 34.

A seat hinge 10 is attached to the front end of each frame side member 8 and hingedly couples the seat assembly 12 to the frame 2. The seat assembly 12 comprises longitudinal-extending, transversely spaced left and right side members 13 each having a front end hingedly coupled to one of the seat hinges 10 such that the seat assembly 12 is pivotable relative to the frame 2 about a horizontal axis, and a rear end coupled to a backrest hinge 15. A transversely-extending seat cross tube 14 connects to the rear of each seat side member 13. A seat bottom can be attached to the side members 13 and span the width and length of the seat 2. The seat bottom can be made of fabric to serve as a sling-type seat upholstery for the user. Alternatively, a solid seat can be substituted for the fabric seat upholstery. While the cross tube 14 shown in the Figures is straight, it can optionally include a shallow arch to prevent seat upholstery made of fabric or some other flexible material, from bottoming out on the cross tube 14.

A backrest assembly 17 is hingedly coupled to the back of the seat assembly 12 by left and right hinges 15, which enable the backrest assembly 17 to pivot about a horizontal axis relative to the seat assembly 12 and frame 2. The backrest assembly 17 comprises transversely-spaced, longitudinally-extending left and right side members 18 connected together near their top ends by a transversely extending cross member 19. This cross member 19 can be used as a handle for an attendant to manoeuvre the wheelchair from behind. The backrest side members 18 are connected at their bottom ends to a backrest base 20, which comprises left and right vertical tubes for receiving the bottom ends of the backrest side members 18, and a horizontal cross tube attached to each vertical tube and that spans the width of the backrest assembly 17. The hinges 15 are attached to the vertical tubes of the base 20 as well as to the rear end of each seat side member 13. A fabric backrest support (not shown) spans the length and width of the backrest assembly 17 to act a sling type support for the user; alternatively, the fabric can be replaced with a solid contoured backrest (not shown).

Figure 5:
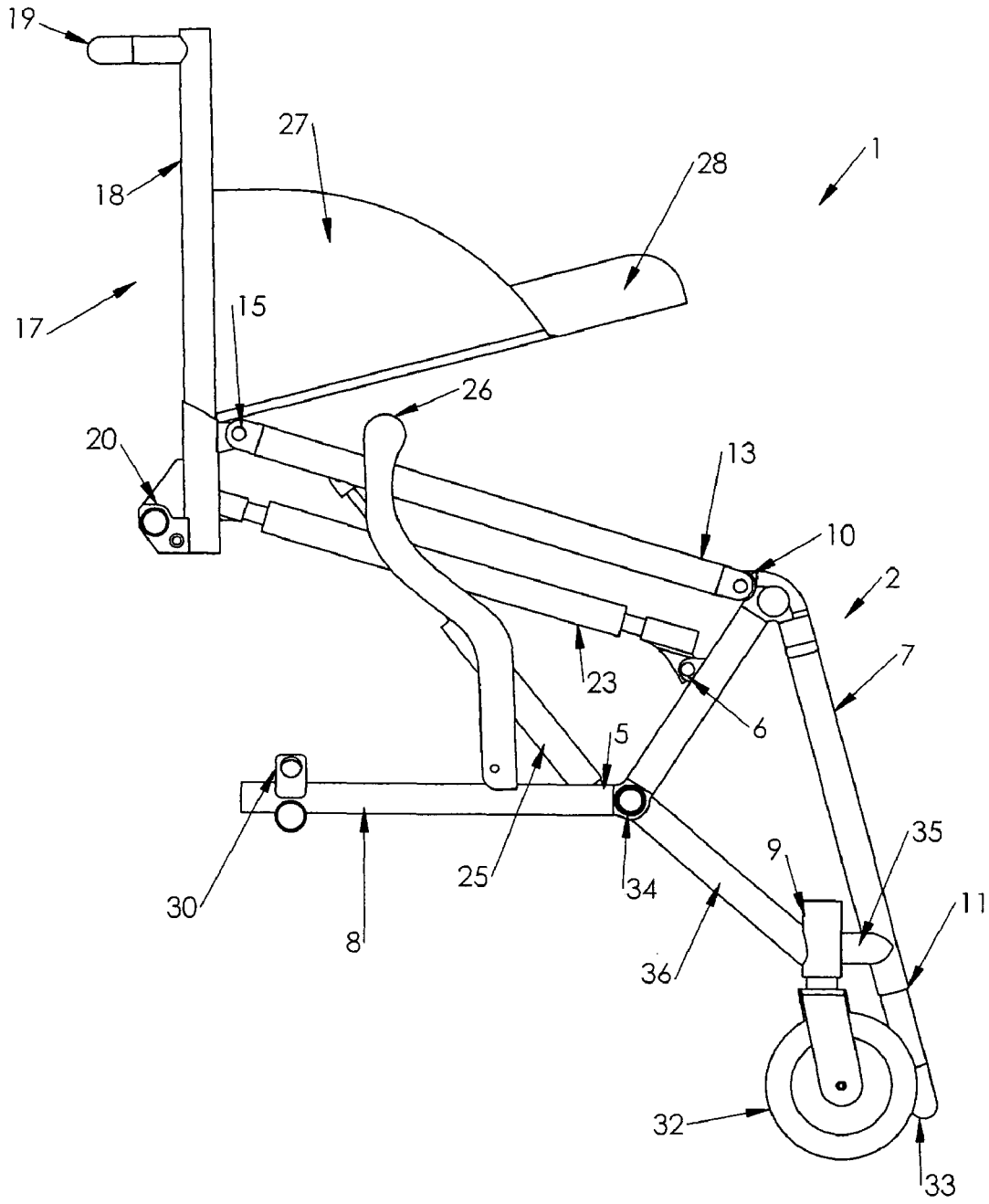
FIG. 5 is a side elevation view of the frame assembly with its seat at a raised elevation.

Left and right side guards 27 are mounted to the backrest frame tubes 18 to provide added hip stability for the user, to protect the user's clothing from getting caught within the spokes of the wheels 31, and to provide means for connecting the backrest assembly 17 to the seat bottom. Such side guards 27 are also referred to as clothing guards or wheel guards. As shown in FIGS. 3 and 5, the seat bottom is a seat cushion 28 and has left and right edges respectively attached to the bottom edge of each side guard 27. As a result of such attachment, the seat bottom angle is maintained substantially constant in relation to the backrest assembly 17. Therefore, when the seat assembly 12 elevates and the side members 13 pivot about hinge 10, the angle of the backrest assembly 17 and seat cushion 28 will remain approximately the same relative to each other and the frame 2. This serves to lift the front of the seat cushion 28 higher when the seat assembly 12 is raised higher, thereby operating to provide additional support for the user's thighs near the knees and providing added stability to prevent the user from sliding out of the chair when the seat assembly 12 is titled upwards, especially above the horizontal.

The seat cushion 28 can be fabric covered foam and can be attached to the side guards 27 and span the width of the seat bottom. Alternatively, any other type of wheelchair cushion can be substituted for the foam. Various means exist for fixedly attaching the cushion to the side guards such as Velcro. Additionally, the seat cushion 28 can be further supported by a bottom, such as fabric or metal, that spans the length and width of the seat bottom, but is not fixedly attached to the seat side members 13.

The side guards 27 can be made of fabric or another somewhat stretchable material; in such case, the angle between the seat cushion and backrest assembly 17 can vary. The variance will depend on the material, the cushion (a flexible cushion will sag and cause the user's legs to move medially, i.e. pinch the legs together), and weight and centre of gravity of the user (e.g. if the user leans forward, the seat cushion may tilt downwards relative to the backrest assembly 17). Alternatively, the side guards 27 can be made of a rigid material, e.g. aluminum, in which case the angle between the seat cushion 28 and backrest assembly 17 is more rigidly fixed.

Optionally, the side guards 27 are adjustable, for instance with a strap and buckle mechanism that runs from the top of the guard at the backrest to the front of the seat cushion, or with Velcro to adjust the location of attachment of the side guard to seat cushion. In this configuration, the side guards 27 can be lengthened or shortened in order to adjust the fit and stability of the seat to a particular user's needs and wants. Thus, the angle between the seat bottom 28 and backrest assembly 17 can be adjusted.

A parallel assembly 22 is connected to the backrest assembly 17 and frame 2 such that the backrest assembly 17 is maintained at substantially the same angle to the frame 2 regardless of the seat pivot angle. The parallel assembly 22 comprises a single elongated turnbuckle-like mechanism 23 having a front end hingedly coupled to a front parallel hinge 6 and a rear end hingedly coupled to a rear parallel hinge 21. The front parallel hinge 6 is mounted to the central portion of the frame upper cross tube 4, and the rear parallel hinge 21 is mounted to the central portion of the cross tube of the backrest base 20. In order for the backrest assembly 17 to maintain a substantially constant angle relative to the frame 2, the positions of the parallel hinges 21, 6 are selected such that the turnbuckle pivots are always substantially parallel to the seat side members 13 regardless of seat bottom angle, and the length of the parallel assembly 22 is substantially the same length as the seat side members 13. Of course, the parallel assembly length can be adjusted to adjust the backrest assembly angle by rotating the central turnbuckle mechanism 23; however, such adjustment does not in practice significantly impair the parallel assembly's ability to maintain the backrest assembly angle substantially constant relative to the frame.

Figure 6:
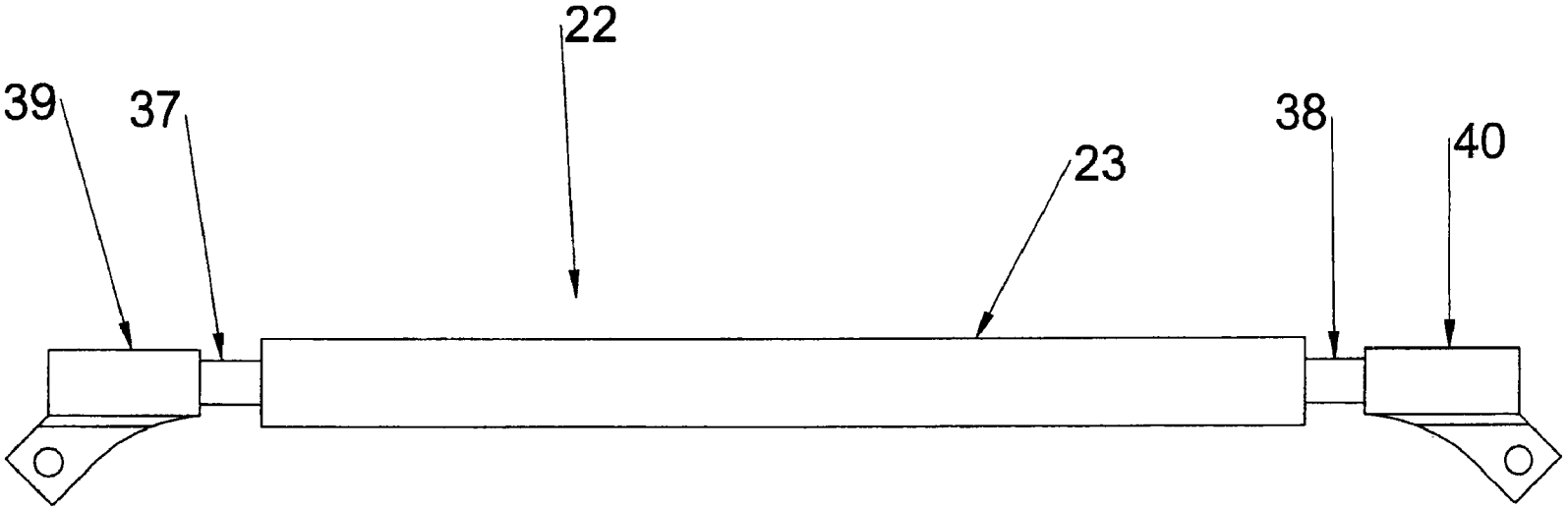
FIGS. 6 and 7 are side elevation views of different embodiments of parallel assembly components of the wheelchair.
Figure 7:
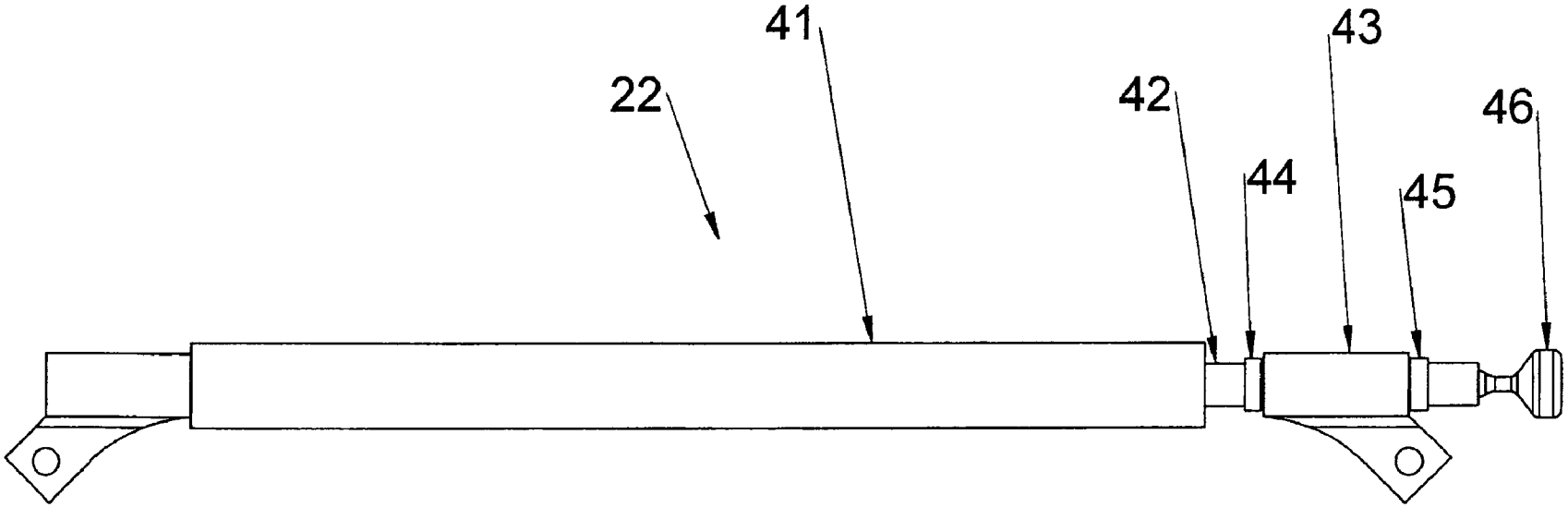

Alternatively and referring to FIGS. 6 and 7, instead of a parallel assembly 22 constructed from a traditional turnbuckle mechanism with opposing directions of screws 37 and 38 at either end screwed into parallel blocks 39 and 40 (FIG. 6), which respectively hingedly couple to parallel hinges 21 and 6, a parallel assembly 22 can be constructed with a fixed length tube 41 with its rear end hingedly coupled to a rear parallel hinge 21 (FIG. 7). The front end of tube 41 is tapped and receives a screw 42, and the screw passes concentrically and freely through a front parallel block 43 that hingedly couples to the front parallel hinge 6. The screw 41 is unable to move longitudinally with respect to the parallel block 43 by the use of 2 fixed nuts 44 and 45 on either side of the parallel block 43. A knob 46 is provided at the front of the screw 42 and can be operated (rotated) to change the length of the parallel assembly 22, thereby changing the angle of the backrest assembly 17 relative to the frame 2. Another alternative embodiment for a parallel assembly 22 is a gas spring, either rigidly or elastically locking, depending on the desire for shock absorbing functions through the backrest. Activating the gas spring will serve to change the length of the parallel assembly and thus the angle of the backrest. The selection of a single, centrally spaced parallel assembly is made at least in part to reduce weight and to minimize complexity. Other approaches as known in the art to maintain a constant backrest assembly angle can be substituted, such as a pair of transversely-spaced fixed-length parallel tubes with a separate seatback angle adjustment mechanism (not shown), if added weight is not a concern.

The length and angle of the front tube of each frame side member 8 are selected so that there is sufficient vertical clearance for the seat assembly 12 to be lowered to a height that is optimal for wheelchair travel. That is, the seat assembly 12 is positionable such that the user's centre of gravity is lowered enough to provide stable and efficient travel, and the user can still comfortably and effectively reach the wheels 31 to propel himself or herself around. In this configuration, the use of a conventional wheel axle or camber tube spanning the width of the seat assembly 12 was avoided, as such tube would prevent the seat assembly 12 from achieving lower horizontal pivot angles (due to interference with the parallel assembly 22). Such interference would come from both the parallel assembly and the seat side frame tubes, and possibly the gas springs, depending on where longitudinally and laterally they are attached. Instead, the camber tube 29 and camber blocks 30 are selected and deliberately located within the frame so as to not interfere with the seat assembly 12 in its downward range of travel. This design enables the wheelchair 1 as shown in this embodiment to lower its seat assembly 12 to a maximum negative pivot angle of 16-17 degrees below the horizontal. It is within the scope of the invention to select a different maximum negative pivot angle, e.g. by raising the vertical clearance of the front tube of the longitudinal members 8, and/or by lowering the vertical position of the camber member 29.

The components of the frame 2 can be manufactured from a light alloy material to reduce the weight of the wheelchair 1. Suitable such materials include cro-moly steel, aluminum alloys, titanium alloys, magnesium alloys, carbon fibre composites, and other materials as used in bicycle manufacturing for instance. By selecting such materials and by utilizing the design of the frame 2 which is designed with a minimum number of parts, it is expected that the weight of the wheelchair 1 can be kept below 30 pounds thereby qualifying it within the ultra-light class of wheelchairs.

The left and right gas springs 25 each have a front end hingedly coupled to respective left and right front gas spring hinges 5 that are mounted in a transversely-spaced arrangement on the middle cross tube 3. The left and right gas springs 25 also have a rear end hingedly coupled to respective left and right rear gas spring hinges 16 that are mounted in a transversely-spaced arrangement on the seat cross tube 14. The gas springs 25 are lockable or adjustable type gas springs as is well known in the art, such as the Varilock EL2 from Suspa Inc. The springs 25 are positioned so that cushioning occurs on the compression stroke of the springs 25. The springs 25 can be locked by a coupled lever 26 at any position between a fully extended position and a fully retracted position. The lever 26 is connected to the springs 25 via cables (not shown) that run from the lower end of the lever 26 to the lower ends of the gas springs 25; such connection is well known in the art and thus not described in detail here. This enables the seat tilt angle to be dynamically adjustable, i.e. adjustable during wheelchair operation, rather than statically adjustable, which requires the user to leave the wheelchair, and possibly require the use of tools to change the seat tilt angle.

The characteristics of the springs 25 can be selected so that the full weight of the user will compress the springs 25 when unlocked, thereby pivoting the side members 13 downwards and lowering the seat assembly 12. Conversely, the springs 25 will extend when a force less than the calibrated force is applied to the unlocked springs 25, thereby causing the side members 13 to pivot upwards and raising the seat assembly 12. The springs 25 can be locked in any position within its range of travel, thereby enabling the seat assembly 12 to be adjustable at multiple angles within its tilt range.

The travel length of the springs 25 are selected to allow the side members 13 to reach a positive pivot angle that sufficiently elevates the seat assembly 12 to useful positions, e.g. to work at a desk or counter top, or to reach elevated objects. In particular, the wheelchair 1 shown in this embodiment is configured to elevate its seat assembly 12 to a maximum positive pivot angle of 20-21 degrees above the horizontal. It is within the scope of the invention to select a different maximum positive tilt angle, e.g. by increasing the maximum extension of the springs 25.

The springs 25 are elastically-lockable type springs which are always compressible at any angle within the seat pivot range. This enables the springs 25 to act as a suspension or shock absorber to dampen any impacts. In this connection, the seat assembly has a lowest elevation in which the springs 25 can be locked. The frame 2 is designed to provide some vertical clearance when the seat assembly 12 is in this lowest elevation. The lowest lockable position of the springs 25 are chosen such that they still have sufficient elasticity to deflect and absorb shock. The combination of this elasticity and the frame clearance allows the seat assembly 12 to deflect downwards when the spring 25 is absorbing shock.

Referring to FIGS. 8 to 11, it is desirable to locate on the wheelchair 1 a seat lift actuator mechanism 26 such that a user can use the same hand to actuate the actuator and stably lift himself partially off the seat bottom, thereby enabling the force of a gas spring to elevate the seat and user. The user's other hand in this configuration may be placed for added stability and lifting force on the opposite wheel or opposite elevated front portion of the wheelchair frame near the front seat hinge 10.

Figure 8:
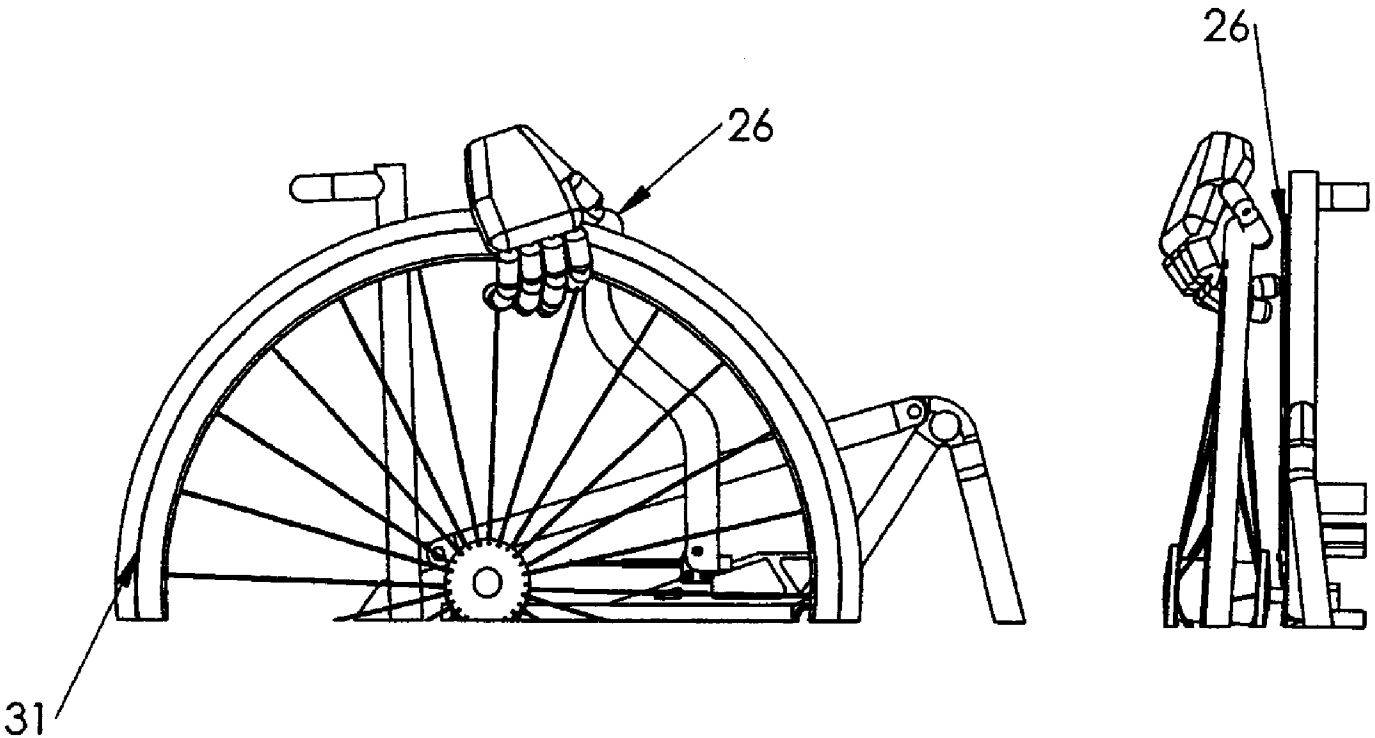
FIG. 8 is a side and front elevation view of the frame assembly showing a user's hand position in relation to the wheel and a seat lift actuation mechanism in the 'neutral' position.
Figure 9:
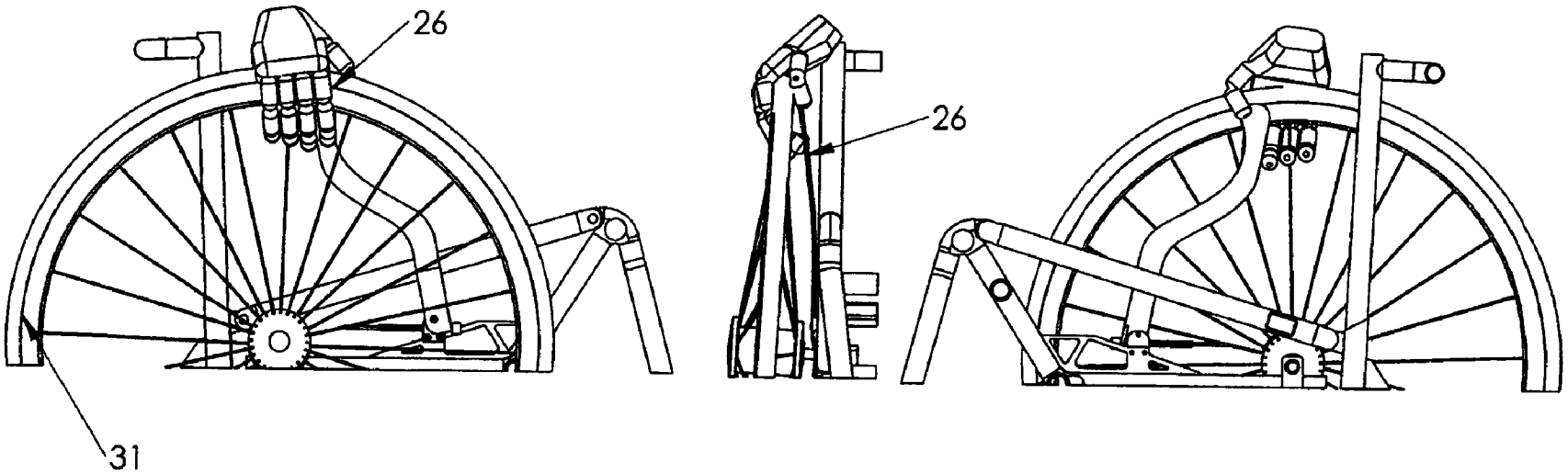
FIG. 9 is a side and front elevation view of the frame assembly showing a user's hand position in relation to the wheel and the seat lift actuation mechanism in the 'actuated' position.

In one embodiment and as shown in FIGS. 8 and 9, a lever mechanism 26 is attached to one side of the frame 2 such that a user can operate the lever 26 while he or she holds on to the wheels 31 (when the wheelchair is not rolling). The frame 2 includes a gusset mounted to the frame member 8; the lever mechanism 26 is hingedly coupled to this gusset (said gusset is omitted in FIGS. 3 and 5 for clarity's sake). By holding onto the wheels 31 while activating the lever 26, the user can push or pull the lever to change their seat position. The lever 26 is located such that it can be operated while the user is holding the wheels 31 of the chair. The lever 26 is positioned near the vertical centreline of the wheel so that pushing off the wheel does not cause the wheel to rotate. The wheels 31 are used to provide a solid base for pushing or pulling the users body weight to assist in the movement of their body as well as adjusting the wheelchair seat height; this design is particularly desirable as it removes the need for a dedicated component such as a handgrip support arm to provide a base for the user, and it simplifies the lever mechanism, thereby reducing overall wheelchair cost and weight. Another advantage is that the user can pivot the wheelchair and adjust the seat height at the same time, by using one hand to actuate the lever and hold the adjacent wheel still, and use the other hand to rotate the wheel either forwards or backwards to turn the wheelchair either clockwise or counter-clockwise. As well, small forwards and backwards movements in the wheelchair are possible while adjusting the seat height by making small movements of the wheel while activating the lever mechanism.

In the embodiment shown in FIGS. 8 and 9, the lever 26 can be grabbed or hooked with the thumb and moved rearward towards the rear of the wheelchair. The rearward movement serves to pull a cable and actuate the release mechanism of the gas springs 25. The cable release mechanism of the gas springs 25 is well known in the art and thus not described in more detail here. As well, it is well known that a single lever mechanism can actuate two gas springs at the same time, thus synchronizing the movement of both gas springs 25. FIG. 8 shows a model of a user's hand in relation to the wheelchair wheel 31 and lever 26 when the lever and gas spring are in the locked or neutral or static position. FIG. 9 shows the user's hand in relation to the wheelchair wheel 31 and lever 26 when the lever 26 has been pulled rearwards and in which the lever 26 and gas springs 25 are in the activated position whereby the user is able to push or pull on the wheels to change the seat height. The lever 26 is constructed such that it is rigid in the rearward direction but flexible laterally. This enables the lever 26 to flex such that a user can activate the lever 26 with their thumb while holding firmly onto the wheels (FIG. 9). Other embodiments of a lever mechanism whereby the user can hold onto the wheels while actuating the gas spring release mechanisms are possible. For instance, the lever 26 could be statically positioned further rearward and rigid and moveable in the lateral direction and unmovable in other directions. A user could grab the lever 26 with the thumb and move the lever 26 laterally toward the wheel 31 to actuate the gas spring release mechanisms while simultaneously holding onto the wheels 31 for pushing or pulling.

Another embodiment would be a handgrip mechanism like a bicycle brake lever (not shown) and which is only attached to the wheelchair 1 by the cables to the gas spring release mechanisms. The flexible attachment of the handgrip by cables would enable a user to dynamically place the handgrip near the wheels 31 and to squeeze the handgrip while holding onto the wheels 31 for pushing or pulling for seat height adjustments. As well, this flexible attachment would enable a user to make small movements of the wheels 31 for pivoting or moving the wheelchair 1 forwards or backwards while activating the gas spring release mechanisms. When not in use, the handle could be stored somewhere convenient such as beside the user's cushion on their hip.

Figure 10:
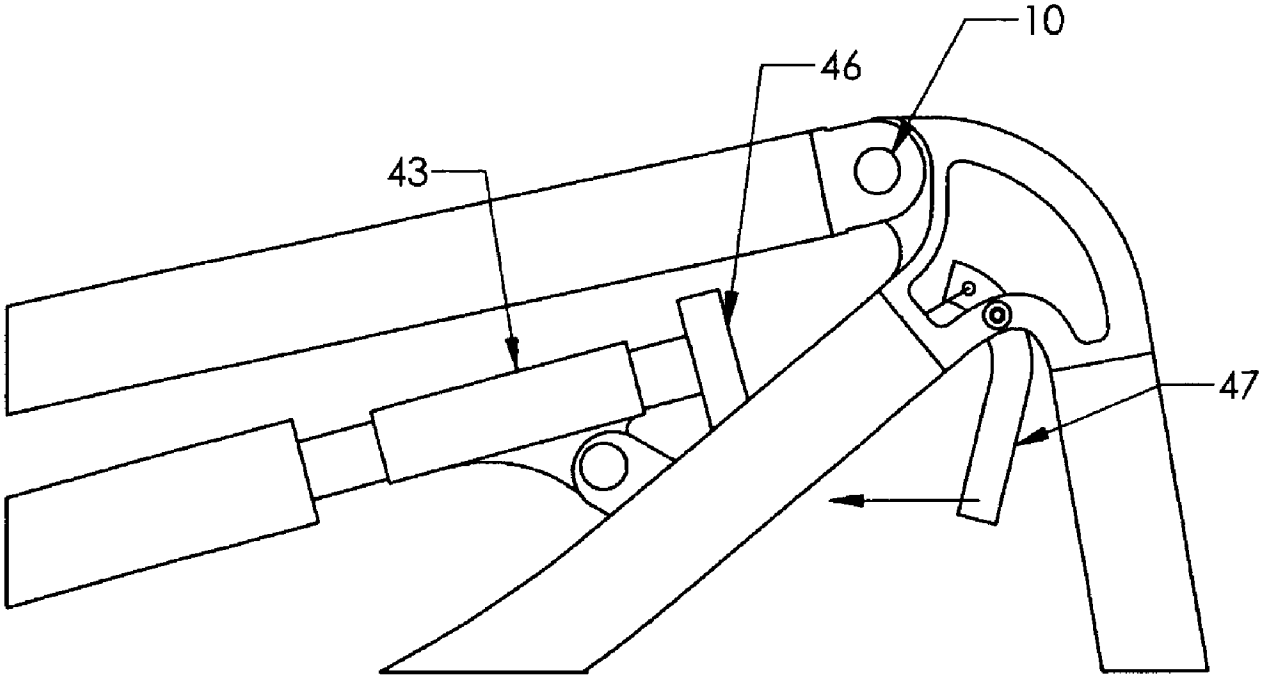
FIGS. 10 and 11(*a*) to (*c*) are side elevation views of the wheelchair having different embodiments of the seat lift actuation mechanism.

Another embodiment of the seat lift actuator mechanism is shown in FIG. 10. Here, a lever 47 is attached to the front elevated portion of the frame 2, near the seat hinge 10 where the seat front attaches to the frame 2. In this embodiment, the lever 47 is integrally built into the frame 2 such that by reaching down, a user is able to grasp the lever 47 and pull or squeeze upwards. The lever movement would pull a cable or cables (not shown) attached to the gas springs 25 in order to actuate the release mechanism of the gas springs 25, similarly to the above described embodiment. A user could then activate the lever 47 while holding onto the front portion of the wheelchair frame 2, while at the same time, the user would be holding onto the opposite wheel 31 or opposite front of the frame 2. Thus with these two hand positions, a user would have a stable base to shift their weight in order to raise or lower the seat height in relation to the frame 2 of the wheelchair 1.

In the embodiments diagrammed in FIGS. 9 and 10, the lever is fixedly attached to the frame 2 of the wheelchair 1. It is understood that the lever (26 for instance, in FIG. 9) can be fixed anywhere on the frame 2 of the wheelchair 1, with the constraint that the user is able to operate the lever 26 while holding onto the wheels 31 or a fixed portion of the frame 2. The user is thus able to place two hands on the wheelchair wheels 31, or one hand on a wheel and the other hand placed on the frame 2 of the wheelchair 1. With these hand positions, the user is able to lift their weight to raise the seat assembly 12 relative to the frame 2 of the wheelchair, or alternatively, the user is able to pull down to lower the seat assembly 12.

Figure 11:
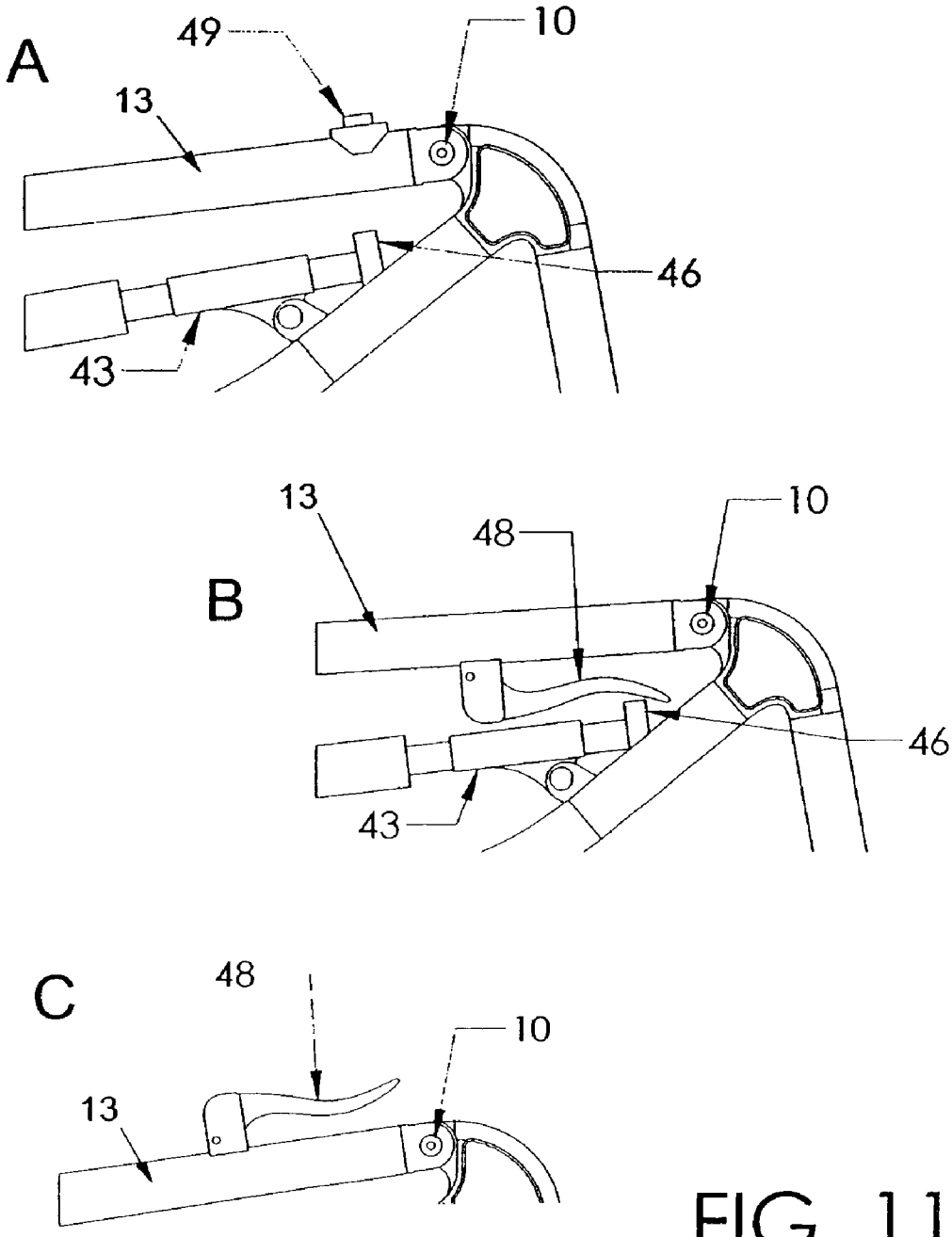

In another embodiment and referring to FIGS. 11(*a*) to (*c*), the seat actuation mechanism is placed on the seat assembly 12 instead of the frame 2 to prevent the user from overextending his reach as the seat assembly 12 elevates with respect to the frame 2. The actuation mechanism is located near the hinge 10 to maximize leverage against the frame; in FIG. 11(*a*), the actuation mechanism is a button 49, and in FIGS. 11(*b*) and (*c*), the actuation mechanism is a lever 48. The user can place one hand on a wheel 31 or fixed portion of the frame 2, such as at the front elevated portion of the frame 2 near the seat hinge 10, while the opposite hand would be placed at the front of seat bottom on one of the side members 13 near the seat hinge 10. The user could then operate the lever 48 or button 49 attached to the seat side member 13 in order to actuate the gas spring release mechanisms 25. The lever 48 or button 49 could be placed above or below the seat side member 13 such that the user can grab the lever 48 or button 49 and squeeze to operate it, or lean with his hand to place weight on the lever 48 or button 49 to operate it. In any embodiment here, the user could operate the gas spring release mechanism 25 by placing one hand on the seat side member 13 (which will move in relation to the frame 2) while the opposite hand is placed on the wheel 31 or some other stable portion of the frame 2. This operating position would enable a user to move the seat assembly 12 higher or lower in relation to the frame 2 of the wheelchair 1. An added feature of the embodiments depicted in FIGS. 11(*a*) to (*c*) is that as the seat assembly 12 rises in relation to the frame 2, the hand position also rises. This means that the user can more comfortably operate the lever 48 or button 49, as well as enabling the seat bottom to rise higher compared to the height possible if the lever 48 or button 49 was attached to the frame 2 because of the limitations of the user's arm length (the ability to reach the lever is constrained by the user's arm length and height of the seat bottom relative to the wheelchair frame).

These embodiments enjoy the particular advantage of not requiring additional components such as special side frames or additional levers for both housing the actuator and providing a stable lifting platform to operate the raising and lowering of the seat. Thus, complexity, weight, and cost are minimized.

It is understood that the force of the gas springs 25 can be calibrated to the weight of a particular user. (This is typically done by installing gas springs with the correct force preconfigured to a user's weight.) It is also understood that gas springs 25 can be chosen to specific operating characteristics of the wheelchair 1. For instance, gas springs 25 can be installed with such forces that a user will naturally lower in relation to the frame 2 when the release mechanism 26, 47, 48, or 49 is operated. This will support the position of the lever 48 or button 49 in FIG. 11 in that the user does not need to struggle to pull the seat down. It is perhaps also a safer method in that the user will always lower instead of rise—rising may cause the user to lose his balance if the user is not fully aware of the circumstances. With such gas spring calibration, the user would just need to lift up to raise the seat bottom, a movement similar to transferring or 'weight-shifting' which typical users would often perform throughout the day.

For any of these embodiments, the mechanical actuation mechanism can be a button that is either squeezed or pressed. The linear motion of the button can pull on cables, such as Bowden cables, that attach to the gas spring release mechanisms. Also, the actuation mechanism of the gas springs can be electrical. That is, a button or switch or some other control system actuator could operate an electrical mechanism (not shown), such as a linear motor or stepper motor or solenoid, to move the release pin on the gas springs 25 and unlock the gas springs 25 for length adjustment. This electrical control system could communicate between the user's switch and the gas springs 25 through either wireless or wired communications equipment and protocols (not shown). It is also understood that any of the embodiments described with cables could be implemented with hydraulics in a similar manner to hydraulic brakes on bikes. Such a system may be beneficial to users with poor hand function, such as quadriplegics, because of the lower forces necessary to operate hydraulic systems compared to cable pull systems.

While the present invention has been described herein by the preferred embodiments, it will be understood to those skilled in the art that various changes may be made and added to the invention. The changes and alternatives are considered within the spirit and scope of the present invention.

What is claimed is:

1. A wheelchair comprising:

(a) a frame having a front portion with a seat hinge mounted thereto at a first elevation, and a rear portion rotatably coupled to left and right wheels;

(b) a seat assembly comprising at least one side member hingedly coupled to the seat hinge, and a seat back hingedly coupled to the side member such that the seat back can be maintained at a substantially constant angle relative to the frame when the side member pivots about the seat hinge and moves the seat assembly between multiple elevations, (c) a lockable spring hingedly mounted to the frame and to the seat assembly, the spring being lockable at multiple positions thereby locking the seat assembly at the multiple elevations;

(d) a seat bottom; and (e) an auxiliary member connecting the seat back to the seat bottom, in which the auxiliary member is operable to maintain the seat bottom at substantially the same angle to the seat back at each of the multiple elevations.

2. A wheelchair as claimed in claim 1 wherein the lockable spring comprises an elastic lockable spring hingedly which is sufficiently elastic to suspend the seat assembly and absorb shock at each of the locked multiple elevations.

3. A wheelchair as claimed in claim 2 wherein the seat assembly is movable into a lowest elevation in which the spring can be locked, and the frame has a selected clearance below the seat assembly when at the lowest elevation, the clearance selected being arranged to allow the seat assembly to deflect downwards when the spring absorbs shock.

4. A wheelchair as claimed in claim 1 wherein the seat assembly comprises a seat bottom hingedly mounted to the seat back or side member such that the seat bottom angle can be adjusted independently of the seat back angle.

5. A wheelchair as claimed in claim 1 wherein the seat assembly further comprises at least one parallel member hingedly coupled to the frame and to the seat assembly in substantial parallel alignment with the side member such that the seat back is maintained in substantially the same angle to the frame at each of the multiple elevations.

6. A wheelchair as claimed in claim 5 wherein the parallel member is adjustable in length, whereupon adjustment of the parallel member length adjusts the seat back angle relative to the frame at each of the multiple elevations.

7. A wheelchair as claimed in claim 1 wherein the auxiliary member comprises at least one side guard connecting the seat back to the seat bottom, said at least one side guard being operable to maintain the seat bottom at substantially the same angle to the seat back at each of the multiple elevations.

8. A wheelchair as claimed in claim 7 wherein the side guard is adjustable in length, whereupon adjustment of the side guard length adjusts the seat bottom angle relative to the seat back at each of the multiple elevations.

9. A wheelchair as claimed in claim 1 further comprising a hand-operated spring actuator coupled to the spring and operable to lock the spring in each of the multiple positions, wherein the actuator is positioned on the seat assembly in a location that enables a user sitting in the wheelchair to use the same hand to actuate the actuator and at least partially lift the user off the seat assembly or pull the seat assembly downwards.

10. A wheelchair as claimed in claim 9 wherein the actuator is located on the side member sufficiently close to the frame that the user can at least partially lift the user off the seat assembly or pull the seat assembly downwards.

11. A wheelchair comprising:

(a) a frame having a front portion with a seat hinge mounted thereto at a first elevation, and a rear portion rotatably coupled to left and right wheels;

(b) a seat assembly comprising at least one side member hingedly coupled to the seat hinge, and a seat back hingedly coupled to the side member, and a linkage coupled to the frame and to the seat assembly such that the seat back can be maintained at a substantially constant angle relative to the frame when the side member pivots about the seat hinge and moves the seat assembly between multiple elevations; and (c) a lockable spring hingedly mounted to the frame and to the seat assembly, the spring being lockable at multiple positions thereby locking the seat assembly at the multiple elevations;

(d) the linkage being adjustable so as to be arranged to adjust the seat back angle relative to the frame at each of the multiple elevations.

12. A wheelchair as claimed in claim 11 wherein the seat comprises a seat bottom hingedly coupled to the seat back or side member such that the seat bottom angle can be adjusted independently of the seat back angle.

13. A wheelchair as claimed in claim 12 wherein the linkage comprises at least one parallel member hingedly coupled to the frame and to the seat assembly in substantial parallel alignment with the side member such that the seat back is maintained in substantially the same angle to the frame at each of the multiple elevations.

14. A wheelchair as claimed in claim 13 wherein the parallel member is adjustable in length, whereupon adjustment of the member length adjusts the seat back angle relative to the frame at each of the multiple elevations.

15. A wheelchair as claimed in claim 11 further comprising a hand-operated actuator coupled to the spring and operable to lock the spring in each of the multiple positions, the actuator located on the wheelchair in a position that allows a user sitting in the wheelchair to use the same hand to actuate the actuator and at least partially lift the user off the seat assembly.

16. A wheelchair as claimed in claim 15 wherein the actuator is positioned on the frame in a location that enables a user sitting in the wheelchair to use the same hand to actuate the actuator and at least partially lift the user off the seat assembly or pull the seat assembly downwards.

17. A wheelchair as claimed in claimed in claim 16 wherein the wheels include an axle and a rim, and the actuator is located sufficiently close to the rim that the user can grasp the rim and actuator at the same time, and the actuator is located sufficiently close to the vertical centreline of the axle that the user can at least partially lift the user off the seat assembly or pull the seat assembly downwards without causing the wheel to rotate.

18. A wheelchair as claimed in claim 15 wherein the actuator is positioned on the seat assembly in a location that enables a user sitting in the wheelchair to use the same hand to actuate the actuator and at least partially lift the user off the seat assembly or pull the seat assembly downwards.

19. A wheelchair as claimed in claim 18 wherein the actuator is located on the side member sufficiently close to the frame that the user can at least partially lift the user off the seat assembly or pull the seat assembly downwards.

20. A wheelchair comprising:

(a) a frame having a front portion with a seat hinge mounted thereto at a first elevation, and a rear portion rotatably coupled to left and right wheels;

(b) a seat assembly comprising at least one side member hingedly coupled to the seat hinge, a seat back hingedly coupled to the side member such that the seat back can be maintained at a substantially constant angle relative to the frame when the side member pivots about the seat hinge and moves the seat assembly between multiple elevations, a seat bottom, and at least one side guard connecting the seat back to the seat bottom, the side guard being operable to maintain the seat bottom at substantially the same angle to the seat back at each of the multiple elevations; and (c) a lockable spring hingedly mounted to the frame and to the seat assembly, the spring being lockable at multiple positions thereby locking the seat assembly at the multiple elevations.

21. A wheelchair as claimed in claim 20 wherein the side guard is adjustable in length, whereupon adjustment of the side guard length adjusts the seat bottom angle relative to the seat back at each of the multiple elevations.

22. A wheelchair as claimed in claim 20 further comprising a hand-operated spring actuator coupled to the spring and operable to lock the spring in each of the multiple positions, wherein the actuator is positioned on the seat assembly in a location that enables a user sitting in the wheelchair to use the same hand to actuate the actuator and at least partially lift the user off the seat assembly or pull the seat assembly downwards.

23. A wheelchair as claimed in claim 22 wherein the seat assembly comprises a side member hingedly coupled to the frame, and the actuator is located on the side member sufficiently close to the frame that the user can at least partially lift the user off the seat assembly or pull the seat assembly downwards.

24. A wheelchair as claimed in claim 20 wherein the spring is hingedly mounted to the frame and to the seat assembly, is lockable at multiple positions thereby locking the seat assembly at the multiple elevations, and is sufficiently elastic to suspend the seat assembly and absorb shock at each of the locked multiple elevations.

25. A wheelchair as claimed in claim 24 wherein the seat assembly is movable into a lowest elevation in which the gas spring can be locked, and the frame has a selected clearance below the seat assembly when at the lowest elevation, the clearance selected to allow the seat assembly to deflect downwards when the gas spring absorbs shock.

* * * * *